US011306543B2

(12) United States Patent
Al-Ghamdi

(10) Patent No.: US 11,306,543 B2
(45) Date of Patent: Apr. 19, 2022

(54) DRILL BIT CUTTER FITTED WITH A THREADED MEMBER

(71) Applicant: Saudi Arabian Oil Company, Dhahran (SA)

(72) Inventor: Bakr Abdulrahim Al-Ghamdi, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 16/796,698

(22) Filed: Feb. 20, 2020

(65) Prior Publication Data

US 2021/0262297 A1 Aug. 26, 2021

(51) Int. Cl.

| | |
|---|---|
| ***E21B 10/633*** | (2006.01) |
| ***E21B 10/567*** | (2006.01) |
| ***E21B 10/627*** | (2006.01) |
| ***E21B 17/042*** | (2006.01) |

(52) U.S. Cl.

CPC ..... *E21B 10/633* (2013.01); *E21B 10/567* (2013.01); *E21B 10/627* (2013.01); *E21B 17/042* (2013.01)

(58) Field of Classification Search

CPC ..... E21B 10/567; E21B 10/62; E21B 10/627; E21B 10/633

USPC ..... 175/413, 432

See application file for complete search history.

(56) References Cited

U.S. PATENT DOCUMENTS

| | | | | |
|---|---|---|---|---|
| 3,271,080 | A | 9/1966 | Gowanlock | |
| 3,771,612 | A | 11/1973 | Adcock | |
| 4,511,006 | A | 4/1985 | Grainger | |
| 5,678,645 | A * | 10/1997 | Tibbitts | E21B 10/5673 175/426 |
| 5,906,245 | A | 2/1999 | Tibbitts et al. | |
| 5,975,811 | A * | 11/1999 | Briese | B23C 5/22 407/40 |
| 6,109,377 | A | 8/2000 | Massa et al. | |
| 6,745,858 | B1 | 6/2004 | Estes | |
| 6,776,247 | B1 | 8/2004 | Bassal | |
| 7,926,597 | B2 * | 4/2011 | Majagi | E21B 10/55 175/435 |

(Continued)

FOREIGN PATENT DOCUMENTS

| | | |
|---|---|---|
| CN | 208534408 U | 2/2019 |
| WO | 2011058532 A2 | 5/2011 |

OTHER PUBLICATIONS

International Search Report and Written Opinion of PCT Application No. PCT/US2021/018668 dated May 31, 2021: pp. 1-13.

*Primary Examiner* — Frederick L Lagman

(74) *Attorney, Agent, or Firm* — Bracewell LLP; Constance G. Rhebergen; Linda L. Morgan

(57) ABSTRACT

Methods and systems for maintaining a drill bit includes positioning a cutter within a recess of a drill bit body so that an initial edge is positioned at a first location that is a radially outward location relative to a blade of the drill bit. A threaded member extended through a central bore of the cutter can be rotated to releasably secure the cutter to the drill bit. The subterranean well is drilled with the drill bit. The threaded member can be rotated in a second direction so that the cutter can be rotated relative to the recess and the initial edge of the cutter is positioned at a second location that is rotationally offset from the first location. The threaded member can be rotated to releasably re-securing the cutter to the drill bit and the subterranean well can continue to be drilled with the drill bit.

9 Claims, 4 Drawing Sheets

(56) References Cited

U.S. PATENT DOCUMENTS 8,011,456 B2 9/2011 Sherwood, Jr.
8,033,764 B2 10/2011 Noggle
8,079,431 B1 * 12/2011 Cooley ..... E21B 10/42 175/432
8,479,845 B1 7/2013 Qian et al.
8,991,523 B2 * 3/2015 Shen ..... B23P 15/28 175/331
9,382,762 B2 7/2016 Cooley et al.
9,482,058 B2 10/2016 Siracki
9,879,484 B2 1/2018 Bilen et al.
10,072,464 B2 9/2018 Do et al.
2002/0096369 A1 7/2002 Glowka et al.
2006/0278441 A1 12/2006 Cooley et al.
2008/0236900 A1 * 10/2008 Cooley ..... E21B 10/573 175/432
2008/0289880 A1 * 11/2008 Majagi ..... C22C 29/06 175/335
2009/0020339 A1 * 1/2009 Sherwood, Jr. ..... E21B 10/633 175/426
2010/0219001 A1 * 9/2010 Shen ..... E21B 10/52 175/432
2011/0088955 A1 * 4/2011 Cooley ..... E21B 10/42 175/428
2011/0114393 A1 * 5/2011 Dolan ..... E21B 10/633 175/428
2012/0043138 A1 2/2012 Myers et al.
2014/0326515 A1 * 11/2014 Shi ..... E21B 10/08 175/365
2016/0153243 A1 * 6/2016 Hinz ..... E21B 10/633 175/57
2016/0290057 A1 10/2016 Zhang et al.
2017/0284161 A1 10/2017 Zhang

* cited by examiner

DRILL BIT CUTTER FITTED WITH A THREADED MEMBER

BACKGROUND OF THE DISCLOSURE

1. Field of the Disclosure

The present disclosure relates to bits for drilling subterranean wells, and more particularly to cutters used in such bits.

2. Description of the Related Art

Drill bits can be used for drilling subterranean wells, as an example, such as hydrocarbon production wells, water wells, injection wells, disposal wells, test wells, or observation wells. The drill bits can be attached at an end of a drill string and rotated. As the drill bit rotates, the drill bit can cut, shear, or fracture the earth and rock formations to drill a bore and form the subterranean well.

Drill bits can be formed of a body that includes a number of blades. The blades can include recesses that contain cutters. In currently available drill bit assemblies, the cutters are secured within the recesses of the drill bit by welding. During the drilling process, the cutters can become worn and damaged. In systems where the cutters are welded to the recesses of the drill bit body, the drill bit can be shipped to a shop or returned to the manufacturer so that the cutters can be evaluated to determine if the cutters can be refurbished, reused, or need to be replaced. In order to remove the cutters, the welds that hold the cutters in place is removed at the shop.

SUMMARY OF THE DISCLOSURE

Embodiments of this disclosure provide systems and methods for maintaining a drill bit on site at the location of the subterranean well so that the drill bit can continue to be used to drill the subterranean well without the need to send the drill bit to the shop or to the manufacturer. Embodiments include threaded members that releasably secure the cutters to the drill bit body so that the cutters can be rotated or removed and replaced on-site, saving both time and money during the drilling process. In this way, a drill bit can be re-used multiple times. Embodiments can further include circumferential profiles that engage mating profiles of the recess to limit relative axial movement between the cutters and the drill bit body.

In an embodiment of this disclosure, a method for maintaining a drill bit used for drilling a subterranean well includes positioning a base end of a cutter within a recess of a drill bit body of the drill bit so that an initial edge of a forward end face of the cutter is positioned at a first location that is a radially outward location relative to a blade of the drill bit. The forward end face of the cutter is an end opposite the base end of the cutter. A threaded member is extended through a central bore of the cutter. The threaded member is rotated in a first direction so that an inner end of the threaded member moves in a direction into a hole of the recess of the drill bit, releasably securing the cutter to the drill bit. The threaded member rotates relative to the central bore of the cutter. The subterranean well is drilled with the drill bit. The threaded member is rotated in a second direction so that the inner end of the threaded member moves in a direction out of the hole of the recess of the drill bit. The threaded member rotates relative to the central bore of the cutter. The cutter is rotated relative to the recess of the drill bit so that the initial edge of the forward end face of the cutter is positioned at a second location that is rotationally offset about an axis of the central bore of the cutter from the first location. The threaded member is rotated in the first direction so that the inner end of the threaded member moves in the direction into the hole of the recess of the drill bit, releasably re-securing the cutter to the drill bit to form a maintained drill bit. The threaded member rotates relative to the central bore of the cutter. The subterranean well is drilled with the maintained drill bit.

In alternate embodiments, the cutter can be a polycrystalline diamond compact cutter and the method can further include extending the threaded member through a diamond table face located the forward end face of the cutter. The recess of the drill bit can include a recess profile that includes a radial profile shoulder that extends in a circumferential direction. The cutter can have a cutter profile that includes a radial cutter shoulder that extends in a circumferential direction. The method can further include engaging the radial profile shoulder with the radial cutter shoulder to prevent relative axial movement between the cutter and the recess of the drill bit. Rotating the cutter relative to the recess of the drill bit can include rotating the cutter profile relative to the recess profile with the radial profile shoulder remaining engaged with the radial cutter shoulder.

In other alternate embodiments, the central bore of the cutter can be free from threads and both rotating the threaded member in the first direction and rotating the threaded member in the second direction can include rotating the threaded member free of threaded engagement between the central bore of the cutter and the threaded member. The hole of the recess of the drill bit can have an end surface that faces in a direction out of the hole and rotating the threaded member in the first direction can include maintaining the inner end of the threaded member within the hole and spaced apart from the end surface of the hole. Rotating the threaded member can include engaging a pattern of an outer end of the threaded member with a tool. The outer end of the threaded member can be opposite the inner end of the threaded member. Rotating the threaded member in the second direction and rotating the cutter relative to the recess of the drill bit can occur at a location of the subterranean well.

In an alternate embodiment, a method for maintaining a drill bit used for drilling a subterranean well includes positioning a base end of a cutter within a recess of a drill bit body of the drill bit. An initial edge of a forward end face of the cutter is positioned at a first location that is a radially outward location relative to a blade of the drill bit, the forward end face of the cutter being an end opposite the base end of the cutter. The recess of the drill bit includes a recess profile that includes a radial profile shoulder that extends in a circumferential direction. The cutter has a cutter profile that includes a radial cutter shoulder that extends in a circumferential direction. The base end of the cutter is positioned so that the radial profile shoulder engages the radial cutter shoulder to prevent relative axial movement between the cutter and the recess of the drill bit. A threaded member that extends through a central bore of the cutter is rotated in a first direction so that an inner end of the threaded member moves in a direction into a hole of the recess of the drill bit, releasably securing the cutter to the drill bit. The subterranean well is drilled with the drill bit. The threaded member is rotated in a second direction so that the inner end of the threaded member moves in a direction out of the hole of the recess of the drill bit, where the threaded member remains in threaded engagement with the hole of the recess of the drill bit. The cutter is rotated relative to the recess of the drill bit so that the initial edge of the forward end face of the cutter is positioned at a second location that is rotationally offset about an axis of the central bore of the cutter from the first location. The radial profile shoulder remains engaged with the radial cutter shoulder, preventing relative axial movement between the cutter and the recess of the drill bit as the cutter is rotated. The threaded member is rotated in the first direction so that the inner end of the threaded member moves in the direction into the hole of the recess of the drill bit, releasably re-securing the cutter to the drill bit to form a maintained drill bit, where the threaded member rotates relative to the central bore of the cutter. The subterranean well is drilled with the maintained drill bit.

In alternate embodiments, the cutter can be a polycrystalline diamond compact cutter having a diamond table face located on the forward end face of the cutter and rotating the cutter relative to the recess of the drill bit includes rotating the cutter so that a damaged portion of the of the diamond table face is positioned rotationally offset about the axis of the central bore of the cutter from the first location. The central bore of the cutter can be free from threads and both rotating the threaded member in the first direction and rotating the threaded member in the second direction can include rotating the threaded member relative to the central bore of the cutter and free of threaded engagement between the central bore of the cutter and the threaded member. Rotating the threaded member that extends through the central bore of the cutter in the first direction can include releasably securing the cutter to the drill bit with the inner end of the threaded member located within the drill bit and inaccessible from an outside of the drill bit.

In another alternate embodiment of this disclosure, a system for maintaining a drill bit used for drilling a subterranean well includes a cutter having a base end located within a recess of a drill bit body of the drill bit so that an initial edge of a forward end face of the cutter is positioned at a first location that is a radially outward location relative to a central axis of the drill bit. The forward end face of the cutter is an end opposite the base end of the cutter. A threaded member extends through a central bore of the cutter. The threaded member is operable to be rotated the in a first direction so that an inner end of the threaded member moves in a direction into a hole of the recess of the drill bit, releasably securing the cutter to the drill bit, and operable to be rotated in a second direction so that the inner end of the threaded member moves in a direction out of the hole of the recess of the drill bit. The recess of the drill bit includes a recess profile that has a radial profile shoulder that extends in a circumferential direction. The cutter has a cutter profile that includes a radial cutter shoulder that extends in a circumferential direction. The base end of the cutter is positioned so that the radial profile shoulder engages the radial cutter shoulder to prevent relative axial movement between the cutter and the recess of the drill bit. The cutter is rotatable relative to the recess of the drill bit so that the initial edge of the forward end face of the cutter is positioned at a second location that is rotationally offset about an axis of the central bore of the cutter from the first location to form a maintained drill bit, where the radial profile shoulder remains engaged with the radial cutter shoulder during rotation of the cutter, preventing relative axial movement between the cutter and the recess of the drill bit as the cutter is rotated.

In alternate embodiments, the cutter can be a polycrystalline diamond compact cutter having a diamond table face located on the forward end face of the cutter. The cutter can be rotatable relative to the recess of the drill bit so that a damaged portion of the of the diamond table face is positioned rotationally offset about the axis of the central bore of the cutter from the first location. The central bore of the cutter can be free from threads and the threaded member can be free of threaded engagement with the central bore of the cutter.

In other alternate embodiments, when the cutter is releasably secured to the drill bit, the inner end of the threaded member can located within the drill bit and inaccessible from an outside of the drill bit. The hole of the recess of the drill bit can have an end surface that faces in a direction out of the hole, and where when the cutter is releasably secured to the drill bit the inner end of the threaded member is within the hole and spaced apart from the end surface of the hole. An outer end of the threaded member can include a pattern that is engagable with a tool, the outer end of the threaded member being opposite the inner end of the threaded member.

BRIEF DESCRIPTION OF THE DRAWINGS

So that the manner in which the features, aspects and advantages of the embodiments of this disclosure, as well as others that will become apparent, are attained and can be understood in detail, a more particular description of the disclosure may be had by reference to the embodiments thereof that are illustrated in the drawings that form a part of this specification. It is to be noted, however, that the appended drawings illustrate only certain embodiments of the disclosure and are, therefore, not to be considered limiting of the disclosure's scope, for the disclosure may admit to other equally effective embodiments.

DETAILED DESCRIPTION

The disclosure refers to particular features, including process or method steps. Those of skill in the art understand that the disclosure is not limited to or by the description of embodiments given in the specification. The subject matter of this disclosure is not restricted except only in the spirit of the specification and appended Claims.

Those of skill in the art also understand that the terminology used for describing particular embodiments does not limit the scope or breadth of the embodiments of the disclosure. In interpreting the specification and appended Claims, all terms should be interpreted in the broadest possible manner consistent with the context of each term. All technical and scientific terms used in the specification and appended Claims have the same meaning as commonly understood by one of ordinary skill in the art to which this disclosure belongs unless defined otherwise.

As used in the Specification and appended Claims, the singular forms "a", "an", and "the" include plural references unless the context clearly indicates otherwise.

As used, the words "comprise," "has," "includes", and all other grammatical variations are each intended to have an open, non-limiting meaning that does not exclude additional elements, components or steps. Embodiments of the present disclosure may suitably "comprise", "consist" or "consist essentially of" the limiting features disclosed, and may be practiced in the absence of a limiting feature not disclosed. For example, it can be recognized by those skilled in the art that certain steps can be combined into a single step.

Where a range of values is provided in the Specification or in the appended Claims, it is understood that the interval encompasses each intervening value between the upper limit and the lower limit as well as the upper limit and the lower limit. The disclosure encompasses and bounds smaller ranges of the interval subject to any specific exclusion provided.

Where reference is made in the specification and appended Claims to a method comprising two or more defined steps, the defined steps can be carried out in any order or simultaneously except where the context excludes that possibility.

Figure 1:
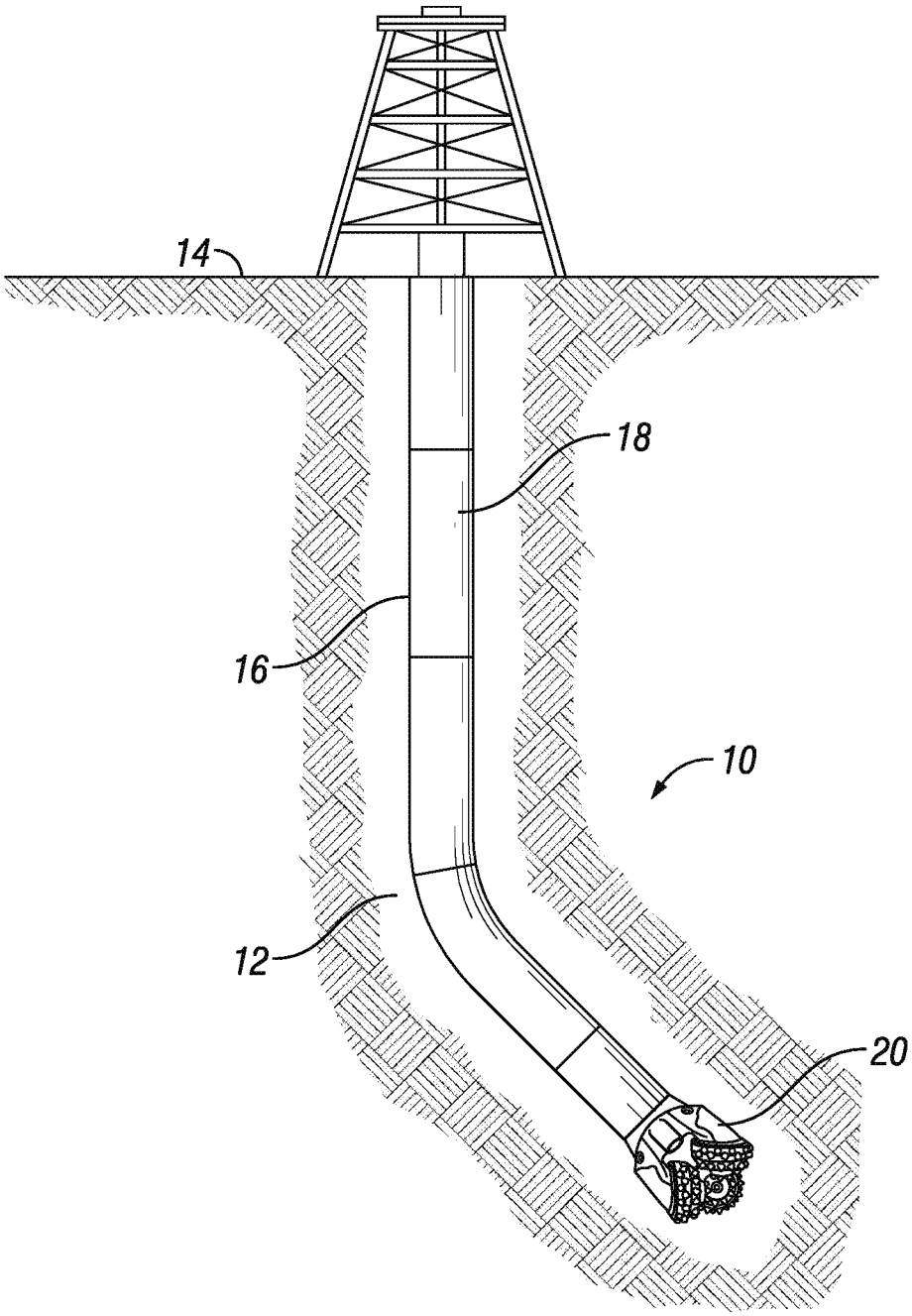
FIG. 1 is a section view of a subterranean well including a drill bit used for drilling the subterranean well, in accordance with an embodiment of this disclosure.

Looking at FIG. 1, subterranean well 10 can have wellbore 12 that extends to an earth's surface 14. Subterranean well 10 can be an offshore well or a land based well and can be used for producing hydrocarbons from subterranean hydrocarbon reservoirs. Alternately, subterranean well 10 can be a water well, injection well, disposal well, test well, observation well, or other known type of subterranean well.

Drill string 16 can be delivered into and located within wellbore 12. Drill string 16 can include tubular member 18 and drill bit 20. Drill string 16 can be used to drill wellbore 12. Wellbore 12 can be drilled from surface 14 and into and through various formation zones of subterranean formations.

Figure 2:
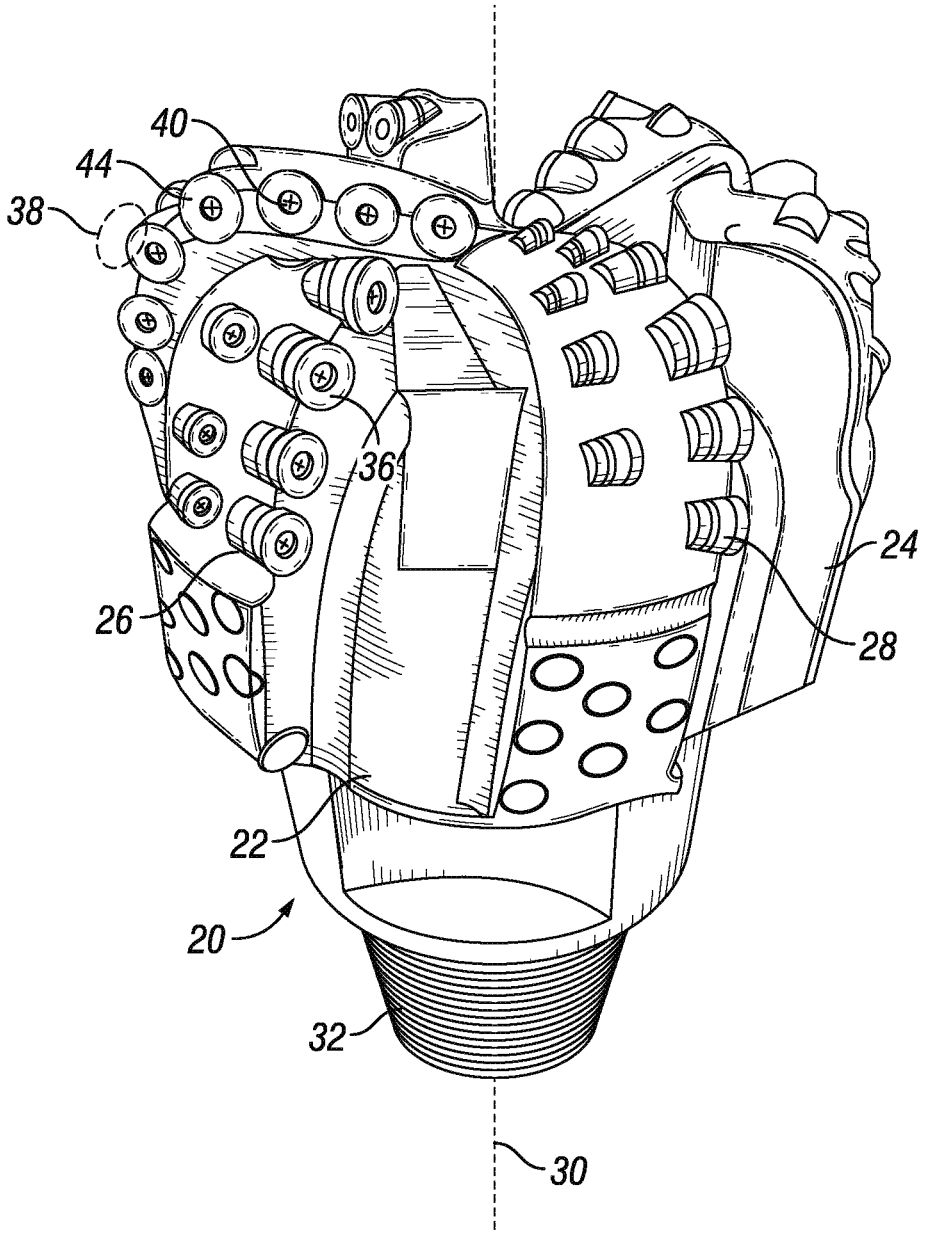
FIG. 2 is a perspective view of a drill bit used for drilling the subterranean well, in accordance with an embodiment of this disclosure.

Looking at FIG. 2, in an example embodiment, drill bit 20 can include drill bit body 22. Drill bit body 2 can be formed of a single molded member that is shaped with a number of blades 24. In the example of FIG. 2, drill bit body 22 includes six blades 24. In alternate embodiments, drill bit body 22 can include more than six blades 24 or fewer than six blades 24. Blades 24 can extend in a direction radially outward from central axis 30 of drill bit 20. Blades 24 can also extend in a direction axially away from a connector end 32 of drill bit 20 that is connectable to tubular member 18 (FIG. 1).

Blades 24 of drill bit 20 can include recesses 26 that contain cutters 28. Each recess 26 can have a generally partial cylindrical shape. Recess 26 can have a length that is less than the length of cutter 28 so that a face of cutter 28 extends out of recess 26. Recess 26 can be shaped to extend partially, but not completely around a circumference of cutter 28. Cutters 28 can have a generally cylindrical shape and be symmetrical about a central axis.

In the example embodiment of FIG. 2, each blade 24 has two rows of recesses 26 with cutters 28. A first row of cutters 28 can be positioned along a leading edge of each blade 24 and a second row of cutters 28 can located behind the first row of cutters 28. Each of cutters 28 extend along blade 24 from a location proximate to central axis 30, radially outward towards an outermost circumference of blade 24 and then along blade 24 in a direction towards connector end 32. The rows of cutters 28 are configured so that a bottom end of recess 26 of a front row of cutters 28 is spaced apart from a front end of recess 26 of a second row of cutters 28. In alternate embodiments, each blade can have a single row of cutters 28.

Cutters 28 are configured to face in a direction so that as drill bit 20 rotates, and forward end face 36 at a forward end of each cutter 28 can engage the earth or formation and cut, shear, or fracture the earth and rock formations to drill wellbore 12 and form subterranean well 10.

Figure 3:
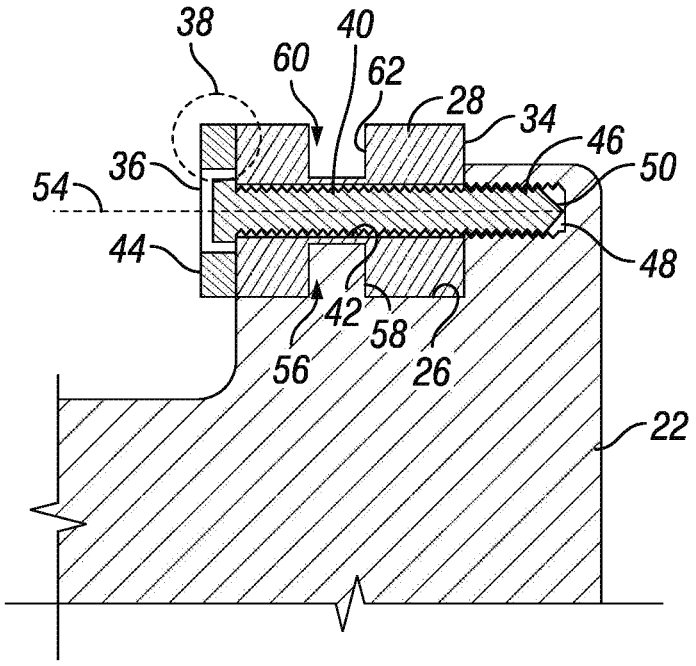
FIG. 3 is a detail section view of a drill bit with a cutter, in accordance with an embodiment of this disclosure.

Looking at FIG. 3, base end 34 is positioned within recess 26. Base end 34 is an end of cutter 28 that is opposite forward end face 36. With base end 34 located in recess 26, initial edge 38 of forward end face 36 of cutter 28 is positioned at a first location that is outward relative to blade 24 of drill bit 20. When initial edge 38 is located as this first location, initial edge 38 is most susceptible to wear and damage during drilling operations. Initial edge 38 is the location of cutter 28 most likely to be worn, chipped, or otherwise damaged during drilling operations.

In embodiments, cutter 28 is a polycrystalline diamond compact cutter with diamond table face 44 located at forward end face 36 of cutter 28. In such embodiments, it can be diamond table face 44 that is worn, chipped, or otherwise damaged during drilling operations.

Threaded member 40 can be used to releasably secure cutter 28 to drill bit 20. Threaded member 40 can extend through central bore 42 of cutter 28. In embodiments where cutter 28 is a polycrystalline diamond compact cutter with diamond table face 44, threaded member 40 can extend through diamond table face 44. When threaded member 40 secures cutter 28 to drill bit 20, a head of threaded member 40 is recessed away from forward end face 36 so that no part of threaded member 40 extends outward past forward end face 36.

Central bore 42 can have a diameter at forward end face 36 that is larger than a diameter of central bore 42 at base end 34. The larger diameter portion of central bore 42 can accommodate a head of threaded member 40 which the smaller diameter portion of central bore 42 can accommodate the threaded portion of threaded member 40. The transition between the larger diameter portion of central bore 42 and the smaller diameter portion of central bore 42 can define a shoulder that engages the head of threaded member 40, allowing threaded member 40 to be tightened against such shoulder when releasably securing cutter 28 to drill bit 20.

Threaded member 40 can be rotated in a first direction so that an inner end 46 of threaded member 40 moves in a direction into hole 48 of recess 26 of drill bit 20. Inner end 46 of threaded member 40 can threadingly engage hole 48 of drill bit 20, releasably securing cutter 28 to drill bit 20. As threaded member 40 is being rotated in a first direction and threaded into drill bit 20, threaded member 40 rotates relative to central bore 42 of cutter 28. In this way, initial edge 38 of forward end face 36 of cutter 28 that is positioned at a first location can remain at the first location while threaded member 40 is rotated. This will allow and operator to position initial edge 38 as desired and maintain the position of initial edge 38 constant while releasably securing cutter 28 to drill bit 20 with threaded member 40.

In order to allow threaded member 40 to rotate relative to central bore 42 of cutter 28, central bore 42 of cutter 28 can be free from threads. Therefore rotating threaded member 40 in the first direction includes rotating threaded member 40 free of threaded engagement between central bore 42 of cutter 28 and threaded member 40.

In order to ensure that there is sufficient space to thread threaded member 40 into drill bit 20 and that threaded member 40 won't stop rotating before cutter 28 is tightly secured to drill bit 20, hole 48 of recess 26 of drill bit 20 can have end surface 50 that is spaced apart from inner end 46 of threaded member 40 when cutter 28 is releasably secured to drill bit 20. End surface 50 faces in a direction out of hole 48. Hole 48 does not extend out of drill bit 20 at an end of hole 48 that is opposite forward end face 36 of cutter 28. When threaded member 40 is releasably securing cutter 28 to drill bit 20, inner end 46 of threaded member 40 is located within drill bit body 22 of drill bit 20 and inaccessible from an outside of drill bit 20.

Figure 4:
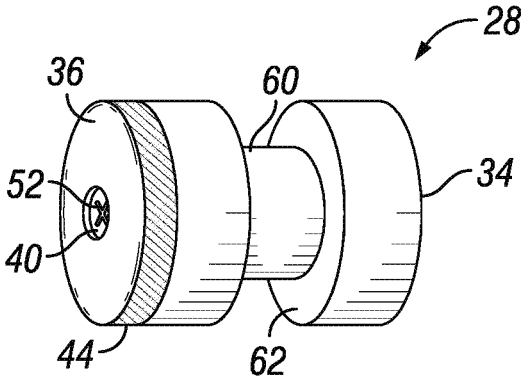
FIG. 4 is a perspective view of a cutter, in accordance with an embodiment of this disclosure.
Figure 5:
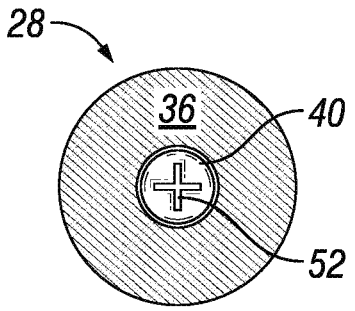
FIG. 5 is an end view of a cutter, in accordance with an embodiment of this disclosure.

Looking at FIGS. 4-5, pattern 52 can be engaged by a tool in order to rotate threaded member 40. Pattern 52 is located at an outer end of threaded member 40 that is opposite inner end 46 of threaded member 40. Pattern 52 can be a common currently available pattern for threaded members, such as a slot, Phillips, Allen, Bristle, Robertson, or other known shape. The tool used for engaging pattern 52 can be a commonly available hand tool. Therefore, rotating threaded member 40 in the first direction can occur at the location of subterranean well 10, or any other location where it is desirable to assembly drill bit 20. Drill bit 20 does not need to be located in a workshop or at the manufacturer's facility in order to releasably secure cutters 28 to drill bit 20. After cutters 28 are releasably secured to drill bit 20, drill bit 20 can be used to drill wellbore 12 of subterranean well 10.

During the drilling of subterranean well 10, cutters 28 can become damaged, and in particular, initial edge 38 of forward end face 36 of cutter 28 can become chipped and worn. In embodiments of this disclosure cutters 28 can be repositioned on drill bit 20 at the location of subterranean well 10, and drill bit 20 can be re-used for drilling subterranean well 10 without having to send drill bit 20 to a workshop or at the manufacturer's facility.

Looking at FIGS. 2-3, threaded member 40 can be rotated in a second direction so that inner end 46 of threaded member 40 moves in a direction out of hole 48 of recess 26 of drill bit 20. When threaded member 40 is rotated in the second direction, threaded member 40 can rotate relative to central bore 42 of cutter 28 and free of threaded engagement between central bore 42 of cutter 28 and threaded member 40. Threaded member 40 does not need to be rotated so far in the second direction that inner end 46 of threaded member 40 is no longer in threaded engagement with hole 48 of recess 26. Threaded member 40 only needs to be rotated in the second direction far enough to allow for cutter 28 to be sufficiently loose to rotate about the central bore axis 54 of central bore 42 of cutter 28.

After threaded member 40 has been rotated a sufficient amount to loosen cutter 28, cutter 28 can be rotated relative to recess 26 of drill bit 20 so that initial edge 38 of forward end face 36 of cutter 28 is positioned at a second location that is rotationally offset about the central bore axis 54 of central bore 42 of cutter 28 from the first location. In embodiments of this disclosure, cutter 28 can be rotated relative to recess 26 of drill bit 20 so that initial edge 38, which can be a diamond table face 44 and can be the damaged portion of cutter 28 is positioned at a second location that is rotationally offset about the axis 54 of central bore 42 of cutter 28 from the first location. In this way, initial edge 38, which is chipped, worn, or otherwise damaged is rotated closer to blade 24 and an undamaged portion of cutter 28 can extend outward from blade 24 and be used to continue drilling subterranean well 10. diamond table face, which can be a damaged portion of cutter 28, After cutter 28 has been rotated, threaded member 40 can again be rotated in a first direction so that an inner end 46 of threaded member 40 moves in a direction into hole 48 of recess 26 of drill bit 20. Threaded member 40 can releasably secure cutter 28 to drill bit 20 by tightening threaded member 40 with a tool that engages pattern 52. Each of the steps of rotating threaded member 40 in the second direction, rotating cutter 28, and rotating threaded member 40 again in a first direction can take place at the location of subterranean well 10, and drill bit 20 can be re-used for drilling subterranean well 10 without having to send drill bit 20 to a workshop or at the manufacturer's facility. After cutters 28 are re-secured to drill bit 20, drill bit 20 can be used to continue drilling wellbore 12 of subterranean well 10.

Looking at FIGS. 3-4, recess 26 of drill bit 20 includes recess profile 56. Recess profile 56 includes radial profile shoulder 58 that extends in a circumferential direction about recess 26. Cutter 28 has cutter profile 60 that includes radial cutter shoulder 62 that extends in a circumferential direction around cutter 28. When releasably securing cutter 28 to drill bit 20, base end 34 of cutter 28 is positioned so that radial profile shoulder 58 engages radial cutter shoulder 62.

Figure 6:
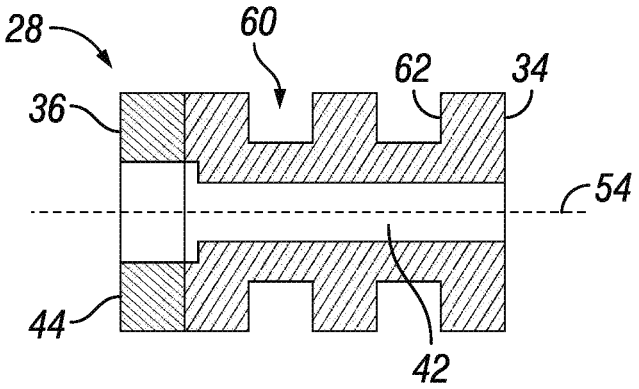
FIG. 6 is a section view of a cutter, in accordance with an embodiment of this disclosure.
Figure 7:
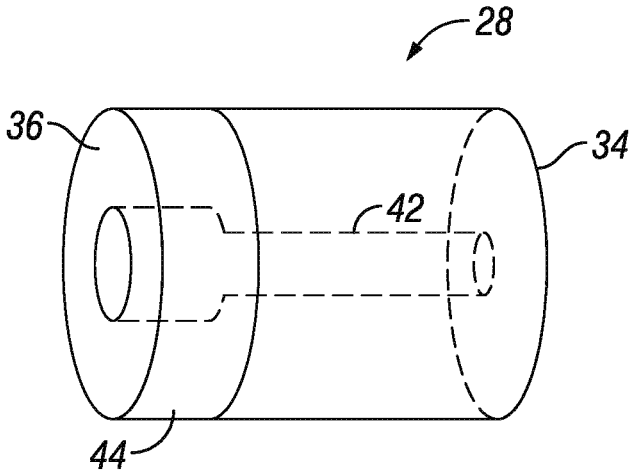
FIG. 7 is a perspective view of a cutter, in accordance with an embodiment of this disclosure.

In the example of FIG. 3, cutter profile 60 is a single groove around cutter 28. In alternate embodiments, cutter profile can include two or more grooves around cutter 28, as shown in the example embodiment of FIG. 6. In such an embodiment, recess profile would include two protrusions from a wall of recess 26. In the example of FIG. 3, recess profile 56 is a protrusion from the wall of recess 26 and cutter profile 60 is a groove around cutter 28. In alternate embodiments, recess profile 56 can be one or more grooves within the wall of recess 26 and cutter profile 60 can be one or more protrusions around cutter 28. In yet other alternate embodiments, cutter 28 may have no cutter profile 60, as shown in the example embodiment of FIG. 7.

The engagement of radial profile shoulder 58 with radial cutter shoulder 62 can prevent relative axial movement between cutter 28 and recess 26 of drill bit 20. The engagement of radial profile shoulder 58 with radial cutter shoulder 62 can maintain the position of cutter 28 relative to drill bit 20 against downhole forces such as the vibrations and shocks related to drilling operations.

When cutter 28 is rotated relative to recess 26 of drill bit 20, the cutter profile 60 can be rotated relative to recess profile 56 with radial profile shoulder 58 remaining engaged with radial cutter shoulder 62. In this way, when cutter 28 is rotated relative to recess 26 of drill bit 20 the engagement of radial profile shoulder 58 with radial cutter shoulder 62 prevents relative axial movement between cutter 28 and recess 26 as cutter 28 is rotated.

In embodiments of this disclosure, current drill bits could be modified to include recess profile 56 and hole 48 of recess 26. Cutters 28 could then be used with such a modified drill bit.

In an example of operation, in order to maintain a drill bit for use in drilling subterranean well 10, cutter 28 can be positioned within recess 26 of drill bit body 22 of drill bit 20. Initial edge 38 of forward end face 36 of cutter 28 is positioned at a first location that is radially outward relative to blade 24 of drill bit 20. Base end 34 of cutter 28 is positioned so that radial profile shoulder 58 engages radial cutter shoulder 62 to prevent relative axial movement between cutter 28 and recess 26 of drill bit 20.

Threaded member 40 extends through central bore 42 of cutter 28 and is rotated in a first direction to releasably secure cutter 28 to drill bit 20. Drill bit 20 can be used to drill subterranean well 10. When cutters 28 become worn or damaged, threaded member 40 can be rotated in a second direction to loosen cutter 28 relative to recess 26. Threaded member can remain in threaded engagement with hole 48 of recess 26.

Cutter 28 can be rotated relative to recess 26 so that initial edge 38 of forward end face 36 of cutter 28, which has been worn or damaged, is positioned at a second location that is rotationally offset about axis 54 of central bore 42 of cutter 28 from the first location. During rotation of cutter 28, radial profile shoulder 58 can remain engaged with radial cutter shoulder 62 preventing relative axial movement between cutter 28 and recess 26 as cutter 28 is rotated.

Threaded member 40 can be rotated once again in the first direction to releasably re-secure cutter 28 to drill bit 20 to form a maintained drill bit. Drilling of subterranean well 10 can then continue using drill bit 20 which is now a maintained drill bit and which has been maintained without the need to send drill bit 20 to a workshop or back to the manufacturer.

Embodiments of this disclosure, therefore, are well adapted to carry out the objects and attain the ends and advantages mentioned, as well as others that are inherent. While embodiments of the disclosure has been given for purposes of disclosure, numerous changes exist in the details of procedures for accomplishing the desired results. These and other similar modifications will readily suggest themselves to those skilled in the art, and are intended to be encompassed within the spirit of the present disclosure and the scope of the appended claims.

What is claimed is:

1. A method for maintaining a drill bit used for drilling a subterranean well, the method including:

positioning a base end of a cutter within a recess of a drill bit body of the drill bit so that an initial edge of a forward end face of the cutter is positioned at a first location that is a radially outward location relative to a blade of the drill bit, where the forward end face of the cutter is an end opposite the base end of the cutter and the cutter has a cylindrical shape symmetrical about a central axis of the cutter, and where the recess of the drill bit includes a recess profile that includes a radial profile shoulder that extends in a circumferential direction, and the cutter has a cutter profile that includes a radial cutter shoulder that extends in a circumferential direction, and where the method further includes engaging the radial profile shoulder with the radial cutter shoulder to prevent relative axial movement between the cutter and the recess of the drill bit;

extending a threaded member through a central bore of the cutter and into a hole of the drill bit body, where the hole has threads;

rotating the threaded member in a first direction by engaging a pattern of an outer end of the threaded member with a tool so that an inner end of the threaded member engages the threads of the hole and moves in a direction into the hole of the recess of the drill bit until the outer end of the threaded member is recessed within the forward end face, releasably securing the cutter to the drill bit, where the threaded member rotates relative to the central bore of the cutter, and where the outer end of the threaded member is opposite the inner end of the threaded member;

drilling the subterranean well with the drill bit;

rotating the threaded member in a second direction so that the inner end of the threaded member moves in a direction out of the hole of the recess of the drill bit, where the threaded member rotates relative to the central bore of the cutter and the cutter remains axially static within the recess of the drill bit body;

rotating the cutter relative to the recess of the drill bit so that the initial edge of the forward end face of the cutter is positioned at a second location that is rotationally offset about an axis of the central bore of the cutter from the first location, rotating the cutter profile relative to the recess profile with the radial profile shoulder remaining engaged with the radial cutter shoulder;

rotating the threaded member in the first direction so that the inner end of the threaded member moves in the direction into the hole of the recess of the drill bit, releasably re-securing the cutter to the drill bit to form a maintained drill bit, where the threaded member rotates relative to the central bore of the cutter; and drilling the subterranean well with the maintained drill bit.

2. The method of claim 1, where the cutter is a polycrystalline diamond compact cutter and the method further includes extending the threaded member through a diamond table face located the forward end face of the cutter.

3. The method of claim 1, where the central bore of the cutter is free from threads and both rotating the threaded member in the first direction and rotating the threaded member in the second direction includes rotating the threaded member free of threaded engagement between the central bore of the cutter and the threaded member.

4. The method of claim 1, where the hole of the recess of the drill bit has an end surface that faces in a direction out of the hole and where rotating the threaded member in the first direction includes maintaining the inner end of the threaded member within the hole and spaced apart from the end surface of the hole.

5. The method of claim 1, where rotating the threaded member in the second direction and rotating the cutter relative to the recess of the drill bit occur at a location of the subterranean well.

6. A method for maintaining a drill bit used for drilling a subterranean well, the method including:

positioning a base end of a cutter within a recess of a drill bit body of the drill bit, where:

an initial edge of a forward end face of the cutter is positioned at a first location that is a radially outward location relative to a blade of the drill bit, the forward end face of the cutter being an end opposite the base end of the cutter;

the cutter has a cylindrical shape symmetrical about a central axis of the cutter;

the recess of the drill bit includes a recess profile that includes a radial profile shoulder that extends in a circumferential direction;

the cutter has a cutter profile that includes a radial cutter shoulder that extends in a circumferential direction; and the base end of the cutter is positioned so that the radial profile shoulder engages the radial cutter shoulder to prevent relative axial movement between the cutter and the recess of the drill bit;

rotating a threaded member that extends through a central bore of the cutter and into a hole of the drill bit body, where the hole has threads in a first direction by engaging a pattern of an outer end of the threaded member with a tool so that an inner end of the threaded member engages the threads of the hole and moves in a direction into the hole of the recess of the drill bit until the outer end of the threaded member is recessed within the forward end face, releasably securing the cutter to the drill bit, where the outer end of the threaded member is opposite the inner end of the threaded member;

drilling the subterranean well with the drill bit;

rotating the threaded member in a second direction so that the inner end of the threaded member moves in a direction out of the hole of the recess of the drill bit, where the threaded member remains in threaded engagement with the hole of the recess of the drill bit;

rotating the cutter relative to the recess of the drill bit so that the initial edge of the forward end face of the cutter is positioned at a second location that is rotationally offset about an axis of the central bore of the cutter from the first location, where the radial profile shoulder remains engaged with the radial cutter shoulder, preventing relative axial movement between the cutter and the recess of the drill bit as the cutter is rotated;

rotating the threaded member in the first direction so that the inner end of the threaded member moves in the direction into the hole of the recess of the drill bit, releasably re-securing the cutter to the drill bit to form a maintained drill bit, where the threaded member rotates relative to the central bore of the cutter; and drilling the subterranean well with the maintained drill bit.

7. The method of claim 6, where the cutter is a polycrystalline diamond compact cutter having a diamond table face located on the forward end face of the cutter and rotating the cutter relative to the recess of the drill bit includes rotating the cutter so that a damaged portion of the of the diamond table face is positioned rotationally offset about the axis of the central bore of the cutter from the first location.

8. The method of claim 6, where the central bore of the cutter is free from threads and both rotating the threaded member in the first direction and rotating the threaded member in the second direction includes rotating the threaded member relative to the central bore of the cutter and free of threaded engagement between the central bore of the cutter and the threaded member.

9. The method of claim 6, where rotating the threaded member that extends through the central bore of the cutter in the first direction includes releasably securing the cutter to the drill bit with the inner end of the threaded member located within the drill bit and inaccessible from an outside of the drill bit.

* * * * *